US005513708A

United States Patent [19]

Sundholm

[11] Patent Number: 5,513,708

[45] Date of Patent: May 7, 1996

[54] SPRAY-HEAD FOR FIGHTING FIRE

[76] Inventor: Göran Sundholm, Ilmari Kiannon kuja 3, SF-04310 Tuusula, Finland

[21] Appl. No.: 940,953

[22] PCT Filed: Feb. 28, 1992

[86] PCT No.: PCT/FI92/00060

§ 371 Date: Apr. 5, 1993

§ 102(e) Date: Apr. 5, 1993

[87] PCT Pub. No.: WO92/15370

PCT Pub. Date: Sep. 17, 1992

[30] Foreign Application Priority Data

| | | | |
|---|---|---|---|
| Mar. 22, 1991 | [FI] | Finland | 911404 |
| Apr. 12, 1991 | [FI] | Finland | 911792 |
| May 20, 1991 | [FI] | Finland | 912433 |
| Jun. 19, 1991 | [FI] | Finland | 913018 |
| Oct. 4, 1991 | [FI] | Finland | 914705 |
| Feb. 28, 1992 | [FI] | Finland | 911028 |

[51] Int. Cl.[6] ..... A62C 37/08

[52] U.S. Cl. ..... 169/37; 169/38; 251/282

[58] Field of Search ..... 169/37, 38, 39, 169/40, 41; 251/282

[56] References Cited

U.S. PATENT DOCUMENTS

| | | | |
|---|---|---|---|
| 270,801 | 1/1883 | Horack | 169/41 |
| 2,799,466 | 7/1957 | Hickerson | 251/282 |
| 3,198,258 | 8/1965 | Werner | 169/37 |
| 3,791,450 | 2/1974 | Poitras | 169/37 |
| 3,837,406 | 9/1974 | Straley et al. | 169/37 X |
| 4,434,855 | 3/1984 | Given | 169/37 |
| 4,590,999 | 5/1986 | Snaper | 169/37 |
| 4,674,535 | 6/1987 | De Menibus | 251/282 |
| 4,702,209 | 10/1987 | Sausner et al. | 251/282 |
| 5,099,882 | 3/1992 | Smith | 251/282 |

FOREIGN PATENT DOCUMENTS

| | | | |
|---|---|---|---|
| 0033062 | 1/1981 | European Pat. Off. . | |
| 2171476 | 9/1973 | France | 169/38 |
| 2242847 | 3/1975 | France | 169/37 |
| 2626649 | 8/1989 | France | 169/37 |
| 160428 | 3/1904 | Germany . | |
| 1030413 | 2/1989 | Japan | 169/37 |
| 874075 | 10/1981 | U.S.S.R. | 169/37 |
| 971362 | 11/1982 | U.S.S.R. . | |
| 988302 | 1/1983 | U.S.S.R. | 169/37 |
| 1140800 | 2/1985 | U.S.S.R. | 169/37 |
| 329228 | 5/1930 | United Kingdom | 169/37 |
| 2017266 | 10/1979 | United Kingdom | 251/282 |

*Primary Examiner*—Gary C. Hoge
*Attorney, Agent, or Firm*—Ladas & Parry

[57] ABSTRACT

A spray-head for fire fighting having a central bore which communicates with a liquid feed line. A movable spindle is positioned within the bore and has an upper end which sealingly engages the bore. The spindle has a shoulder for defining an annular space between a lower end of the spindle and the surrounding wall of the bore. A second bore extends through the spindle and communicates the annular space with the liquid feed line. The annular space has the same cross-sectional area as the upper end of the spindle, such that the force of the liquid pressure acting on the upper end of the spindle is counteracted by the force of the liquid pressure acting on the shoulder. A spring force is arranged to act on the spindle in the direction of release, and a fusible release element opposes the spring force.

14 Claims, 10 Drawing Sheets

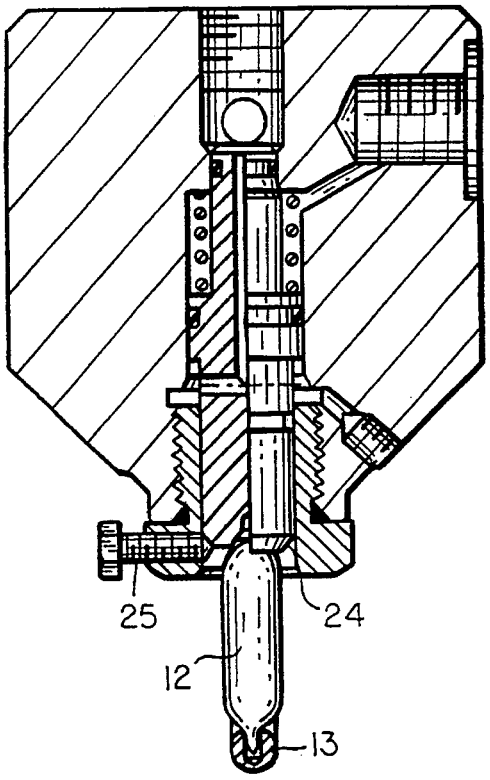
FIG. 9
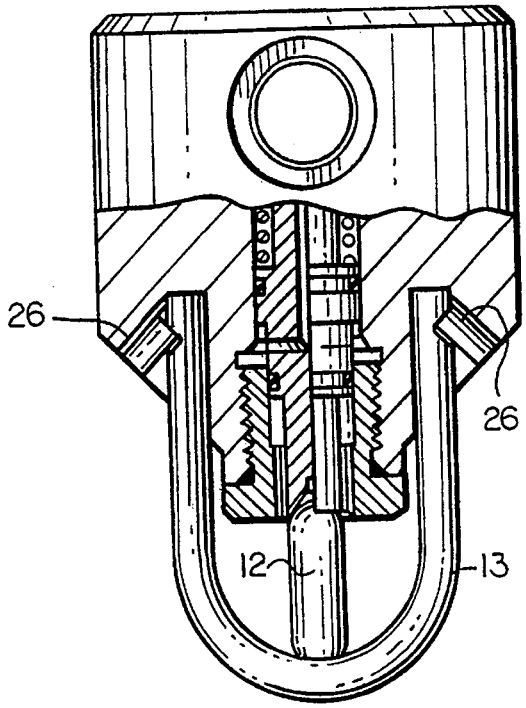
FIG. 10
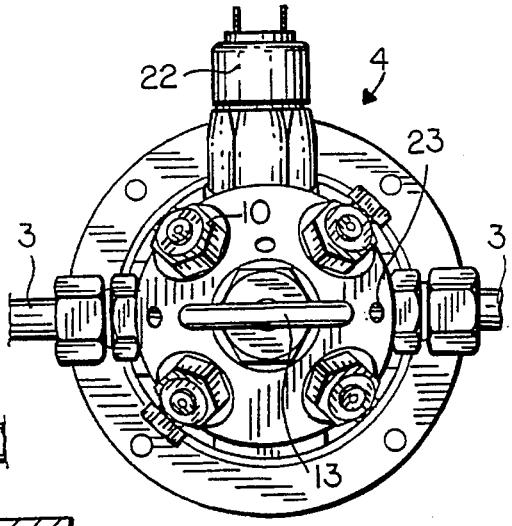
FIG. 11
FIG. 12
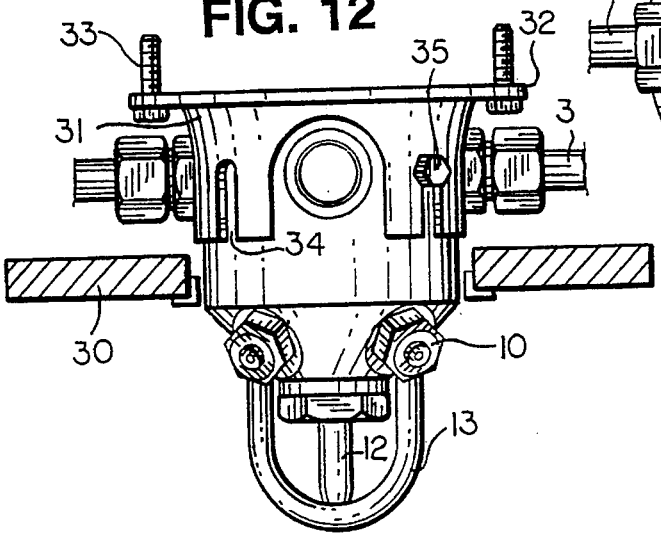

SPRAY-HEAD FOR FIGHTING FIRE

The present invention relates to a spray head for fighting fire.

Known spray heads operate at a liquid pressure of about 7 to 10 bar and require large quantities of water, wherefore the pipelines of the respective fire fighting system are inevitably large in dimensions and water damages are generally considerable.

The object of the invention is to provide a new spray head which can operate at a high liquid pressure, e.g. about 100 bar.

The spray head according to the invention, by which the above object is achieved, is mainly characterized in that it comprises a housing with a central boring in which a movable spindle is arranged; that the spindle comprises a shoulder for defining an annular space between the spindle and a surrounding boring wall; that the annular space communicates with a respective feed line and has the same cross-sectional area as the end of the piston subjected to the liquid pressure prevailing in the line, and that a spring force is arranged to act on the piston in the direction of release.

Due to said annular space, which compensates for the influence exerted on the spindle by the liquid pressure prevailing in the feed line, only said spring force acts on the release means in its inactivated state, the release means being usually a glass ampoule and does not withstand any high mechanical loads.

The high liquid pressure produces a fog-like spray of the fire fighting liquid with very small liquid drops which require a small quantity of water in relation to their fire fighting capacity and thus the resultant water damages are insignificant in comparison with the previously known equipment. The pipe lines of the system can be considerably smaller in dimensions than what has been possible previously.

If desired, the system pressure can be kept constantly at the working pressure, which is high; preferably, however, the operating means of the system, usually a pump, is arranged to be activated to the working pressure from a considerably lower inactive rest-state pressure only after the detection of a fire.

As the spray heads are pressure compensated, the high working pressure of the fire fighting system, prevailing at least after the detection of a fire, does not lead to an undesired release in places where there is no fire; the high liquid pressure does not break the release means in question.

Similarly, if a fire breaks out in a ship cabin, it may be desirable that the spray heads in the neighbouring cabins are activated. In a preferred embodiment of the invention, the spray heads are therefore provided with a device for causing the release means to activate the spray head possibly on the basis of an advance judgement.

Existing release means usually comprise a glass ampoule containing liquid which expands on heating, or a fuse. An electric heating coil positioned about the release means is thus suitable for the purpose. The heating coil can be switched on automatically or manually.

In addition to activation as a precaution by breaking the ampoule by the heat of the coil before the temperature in the cabin does it, it is suggested that the system be provided with means for activating the heating coil positioned about the ampoule at an early conventional alarm indication, such as a detected formation of smoke, or with some other means for switching on the equipment as early as possible in case of fire.

In this way, people sleeping in the cabin are protected from smoke poisoning, in addition to which a cabin fire can be extinguished with a smaller quantity of water.

With an explosive fire, whereby so-called over-ignition of flue gases may take place, there is a risk that the spraying of the fog-like fire fighting liquid is not able to extinguish the first but only smother it partially. In order to ensure that the fire will be extinguished in such a case, it is suggested that the spindle of the spray head is provided with an axial, through-going boring the outlet end of which is closed with a plug such that it comes off at elevated temperature, whereafter a large quantity of liquid, e.g. about 50 l/min, can be sprayed through the axial boring.

The plug can be fixed to the spindle end by soldering with a solder material or it may be made of a solder material which melts at a relatively low temperature, such as 200° C. Alternatively, the plug may be made of a special metal which shrinks when the temperature rises; the plug is installed in position in heated state so that it is fastened in place on cooling and when the temperature rises in case of fire, the plug shrinks and falls off.

Transition from the so-called fog formation stage to the highly efficient fire-fighting may be unnecessarily retarded as the moist fog cools the lower portion of the spray head, where the fuse is positioned, the melting of the fuse being thus retarded.

To overcome this problem, it is suggested that an umbrella-like member, is provided between the fog forming nozzles and the lower portion of the spray head.

The umbrella-like member not only prevents water drops from above from cooling the lower portion of the spray head but also provides the advantage that, at the beginning of a fire, it gathers the warm upwardly rising air against the ampoule, the melting of which initiates the first fire fighting stage, that is, the so-called fog-formation stage.

The invention also relates to a fire fighting system comprising at least one main line which is fed by a pump and from which branches extend to individual spray heads of the described construction. The system is characterized in that the main line is dual;

that a circulation pump is connected to the dual main line for optional flushing of the equipment in the rest state; and that the dual main line is arranged to be connected in parallel on the activation of the liquid pressure.

In the following the invention will be described with reference to the embodiments shown in the attached drawing.

FIG. 9 shows an alternative embodiment of a spray head similarly in section and in the same state as in FIG. 4.

FIG. 10 shows the spray head shown in FIG. 4 in section at right angles to the section shown in FIG. 4.

FIG. 11 shows a spray head from the nozzle side.

FIG. 12 shows a preferred way of installing a spray head.

Figure 1:
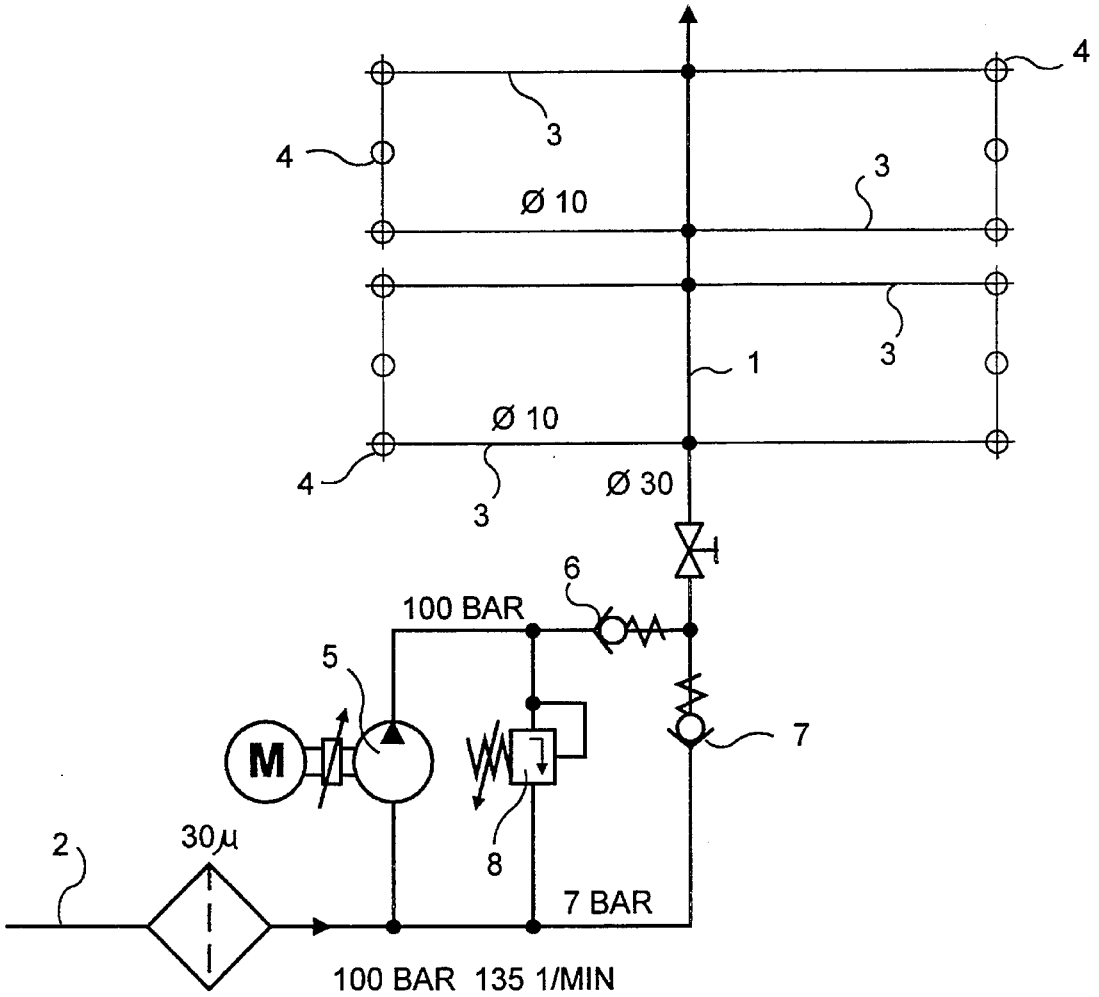
FIGS. 1 and 2 are schematic views of two embodiments of a fire fighting system.

In the embodiment shown in FIG. 1, a so-called single-line system, the reference numeral 1 indicates a main feed line of a fire fighting system, with a diameter of e.g. 30 mm, and 2 indicates its inlet line, 3 indicates branch lines with a diameter of e.g. 10 mm, extending from the main line to a spray head 4.

The main line 1 is fed by a pump 5 having a pressure capacity of e.g. 100 bar, which is used only when fire fighting is needed; in a state of readiness or rest state, nonreturn valves 6 and 7 together with an overflow valve 8 take care that a pressure of only e.g. 7 bar prevails in the main line.

Figure 2:
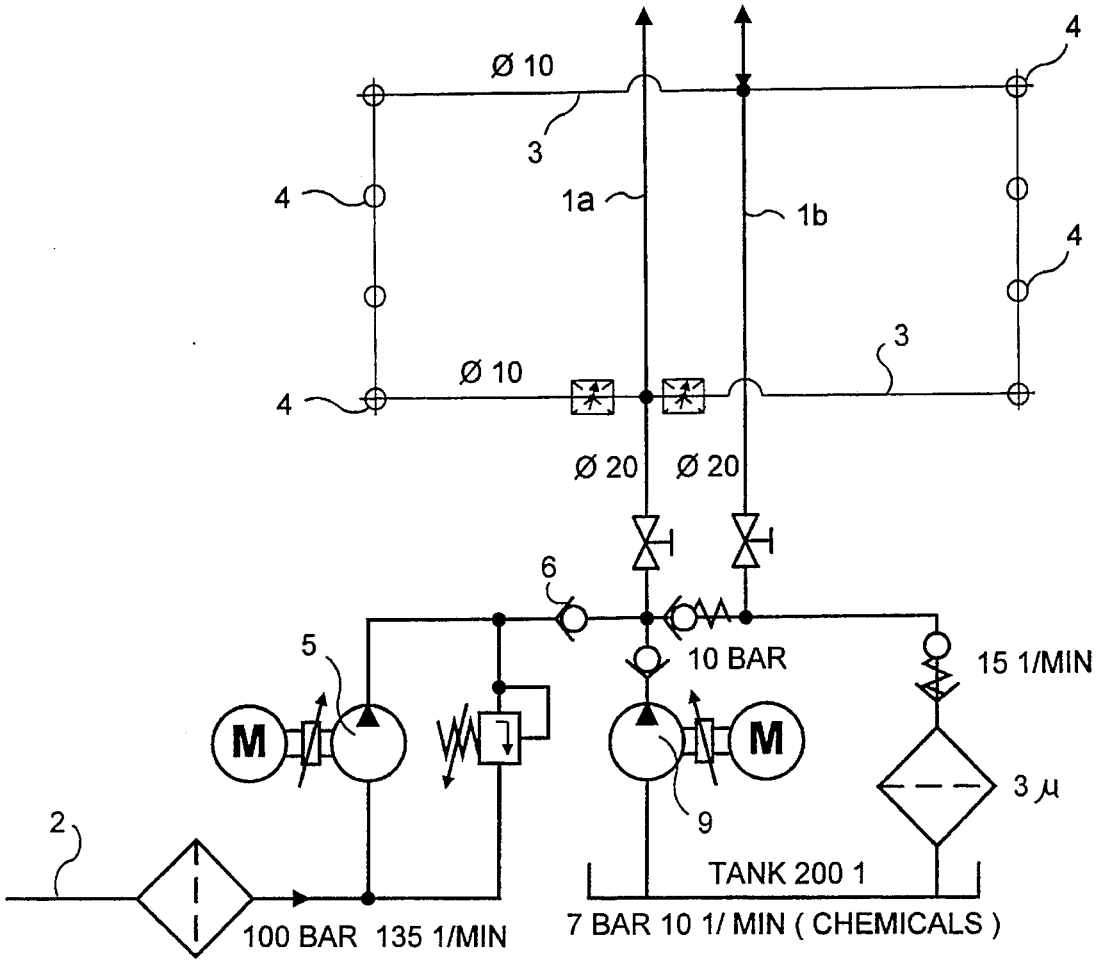

The embodiment shown in FIG. 2, a so-called two-line system, comprises a dual main line 1*a*, 1*b*, and a second feed pump 9 with a working pressure of e.g. 10 bar. In the state of readiness or rest state, the pump 9 can be used for creating a flushing liquid flow with an addition of desired chemicals through the system so as to prevent the accumulation of impurities, the line 1*a* acting as a feed line and the line 1*b* as a return line. When fire fighting is needed, the high-pressure pump 5 is switched on so that both the line 1*a* and the line 1*b* (diameter e.g. 20 mm) act as a main feed line while the line 2 acts as an inlet line, as in FIG. 1.

In FIGS. 3 to 8, 3 and 4 indicate, similarly as above, liquid pipes and a spray head. The individual nozzles of the spray head are indicated with 10.

Figure 3:
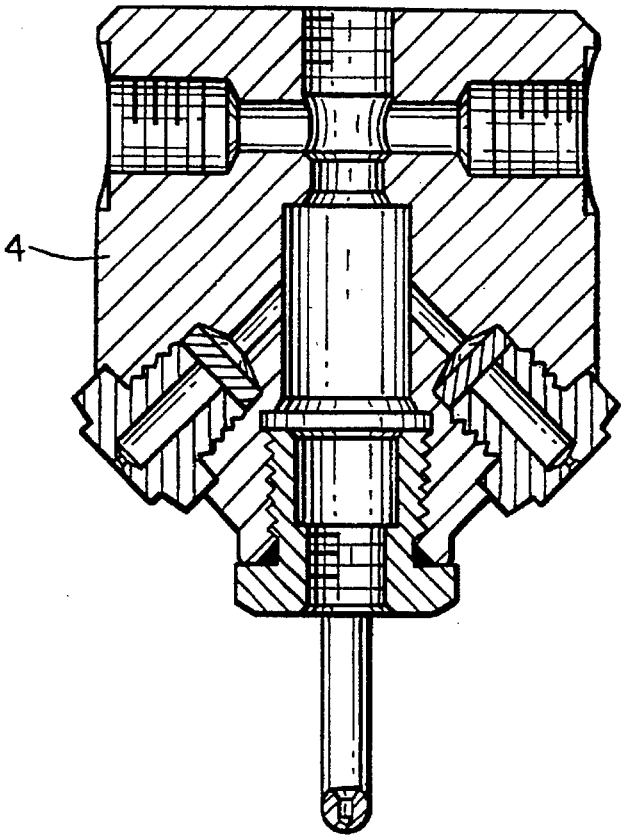
FIGS. 3 and 4 show a spray head housing and a detached/spindle, respectively.
Figure 4:
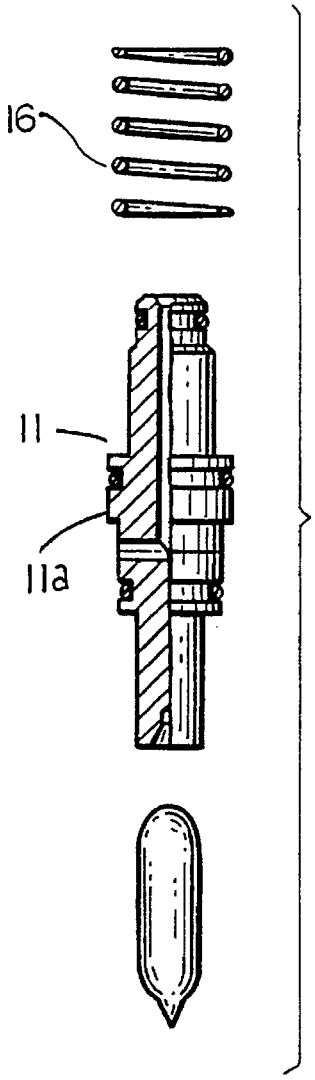

FIGS. 3 and 4 show a spray head housing and a spindle, respectively, when apart from each other. FIG. 4 shows a shoulder 11*a* of the spindle 11 for forming an annular space 15 between the spindle 11 and the wall of the boring.

The spindle 11 is positioned in a boring extending from the pipe 3 toward the nozzles 10, and its outer end bears against a release means 12 which melts/breaks at a predetermined temperature and which bears against a retainer loop 13.

An axial boring 14 extends through the spindle 11 to the annular space 15, the cross-sectional area of which is as large as the cross-sectional area of an end of the spindle 11 which is positioned close to the liquid pipe and on which the liquid pressure acts. In an inactivated state, the liquid pressure prevailing in the line 3 will not, irrespective of the pressure value, press the spindle 11 against the release means 12, which is relatively weak mechanically. Only the springs 16 in the annular space 17 press the spindle 11 against the means 12 in the rest state.

Figure 7:
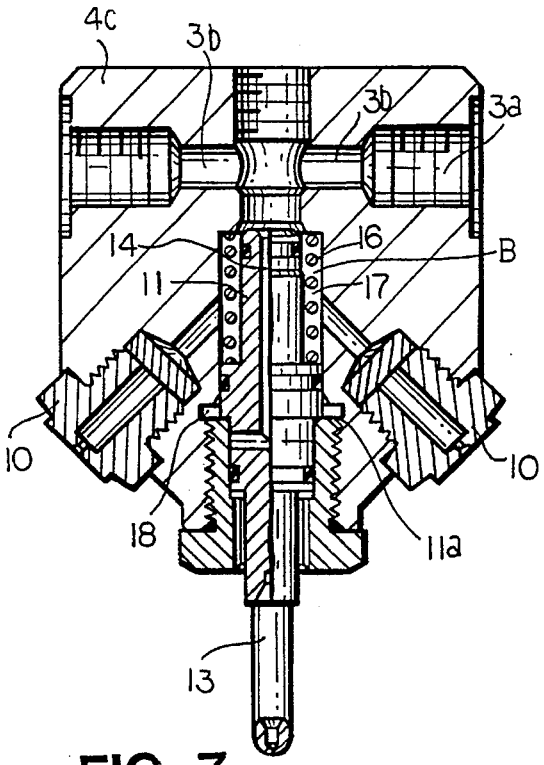
FIGS. 7 and 8 show the spray head in activated state.
Figure 8:
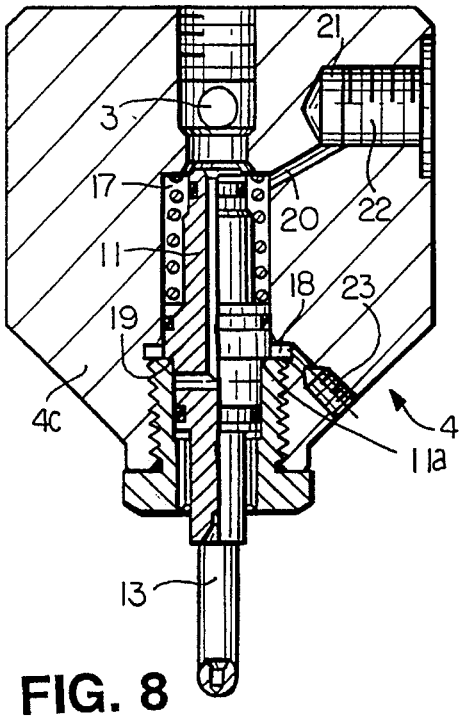

After the release means 12 has melted or broken, FIGS. 7 and 8, the spring 16 forces the spindle outward until a connection from the line 3 to the annular space 17 of the spring 16 opens past the spindle end, whereafter the liquid pressure, e.g. 100 bar, dominates and forces the spindle more rapidly onward. The annular space 18 dampens the movement when the transverse boring of the annular space 15 reaches a conical surface 19. The annular space 17 communicates with the nozzles 10.

Due to the annular compensation space 15 the high liquid pressure does not break the release means 12 in such spray heads of the system where there is no need of fire extinguishing.

Figure 6:
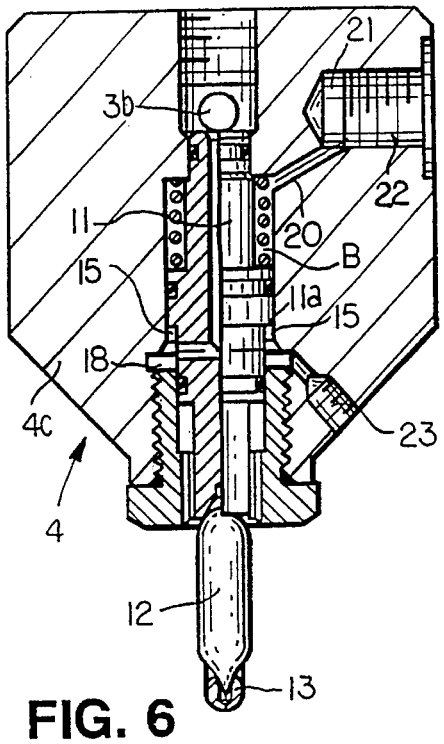

As appears from FIGS. 6 and 8, the inner end of the annular space 17 close to the line 3 preferably communicates by means of a conduit 20 and a space 21 with a pressure switch 22 which is preferably arranged to be switched on at a pressure less than 1 bar, e.g. at 0.1 bar, thus activating the liquid pressure in the line 3.

The system usually comprises alarm gauges responsive to smoke or temperature. The pressure switch 22 can be utilized either so that it may alone activate the liquid pressure when the alarm gauge does not respond and the means 12 melts, or so that the activation of the liquid pressure requires both an alarm from the smoke indicator and the pressure switch to be switched on, so that unnecessary water damages can be avoided if the means 12 is broken by mistake.

An air bleeding valve is indicated with 23; air pockets possibly remaining in the system after installation may cause damage on activation on account of the high liquid pressure.

In the embodiment shown in FIG. 9, the outer end of the spindle 11 is provided with a bevel cutting 24 against which the end of a screw 25 can be driven, whereafter, if required, the release means 12 and the loop 13 can be removed for maintenance, for instance. In FIG. 10, 26 indicates the attachment of the loop 13 to the spray head.

Figure 13:
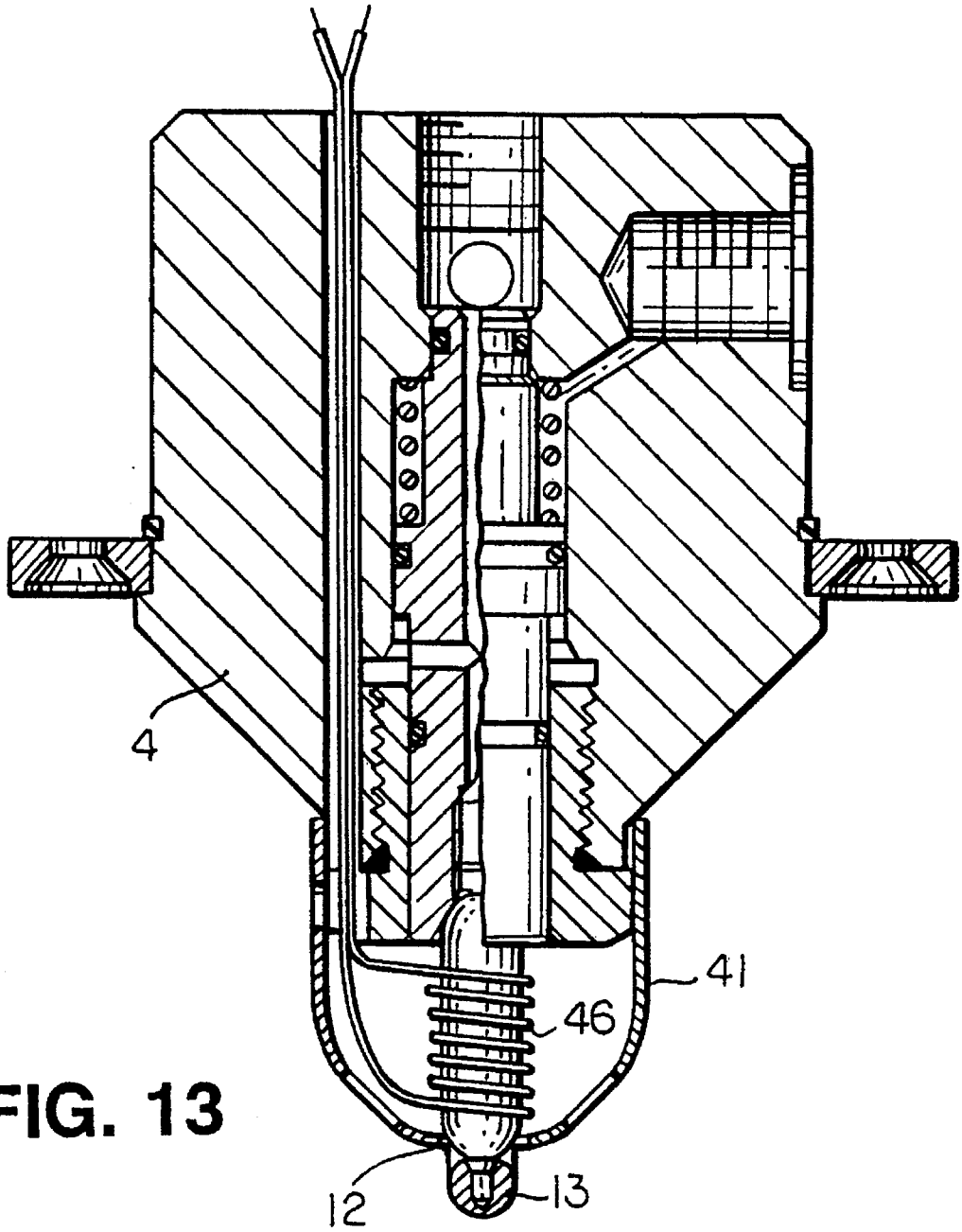
FIG. 13 shows an embodiment with the heating coil positioned about the release means.

In FIG. 13, 46 indicates an electric heating coil fitted around the release means 12, and 41 indicates a protection cap with openings allowing the entrance of ambient air.

In FIG. 12, 30 indicates the visible inner ceiling which usually is not able to carry the spray head and pipes. These are attached to the load-bearing ceiling through a collared pipe section 31 by means of a flange 32 and through-going fastening bolts 33. The spray head is attached to the pipe section 31 by means of bolts 35. Slits 34 enable installation in the vertical direction.

In the case of a so-called normal fire, the above-described embodiments suffice for extinguishing the fire with a fog-like spray of fire fighting liquid.

However, so-called over-ignition may sometimes take place, i.e. the flue gases flare up with a resultant explosive fire. Fog alone is not able to extinguish this type of fire but only smothers it partly. This problem will be discussed below with reference to FIGS. 14 to 19.

Figure 14:
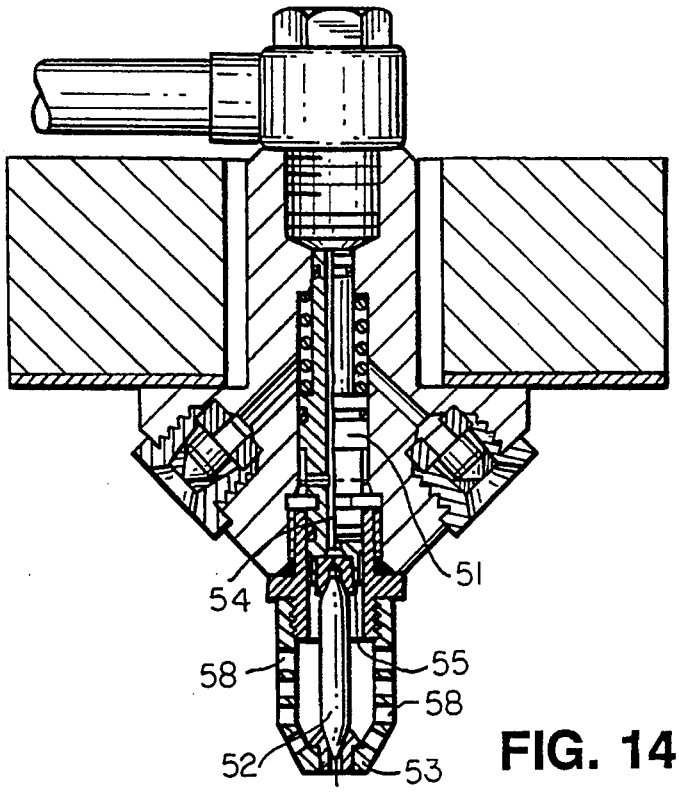
FIG. 14 shows a further alternative embodiment of the spray head in inactivated state.
Figure 15:
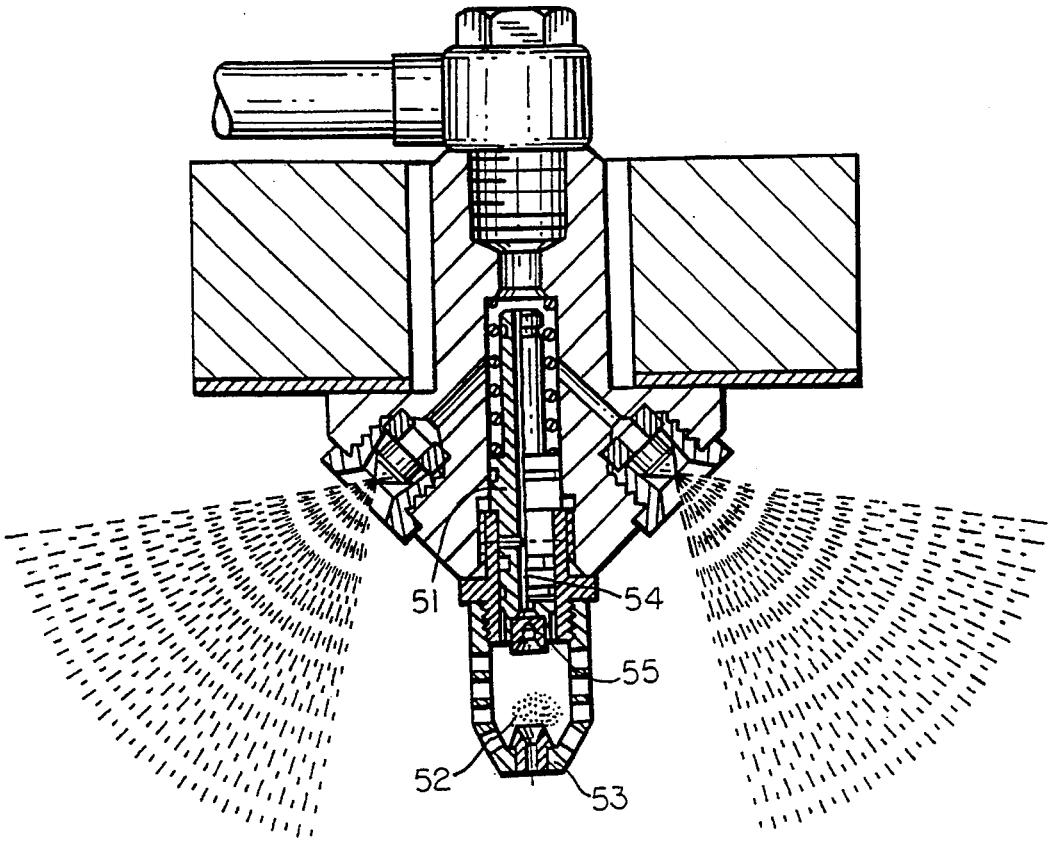
FIG. 15 shows the embodiment of FIG. 12 when spraying fog-like fighting liquid.
Figure 16:
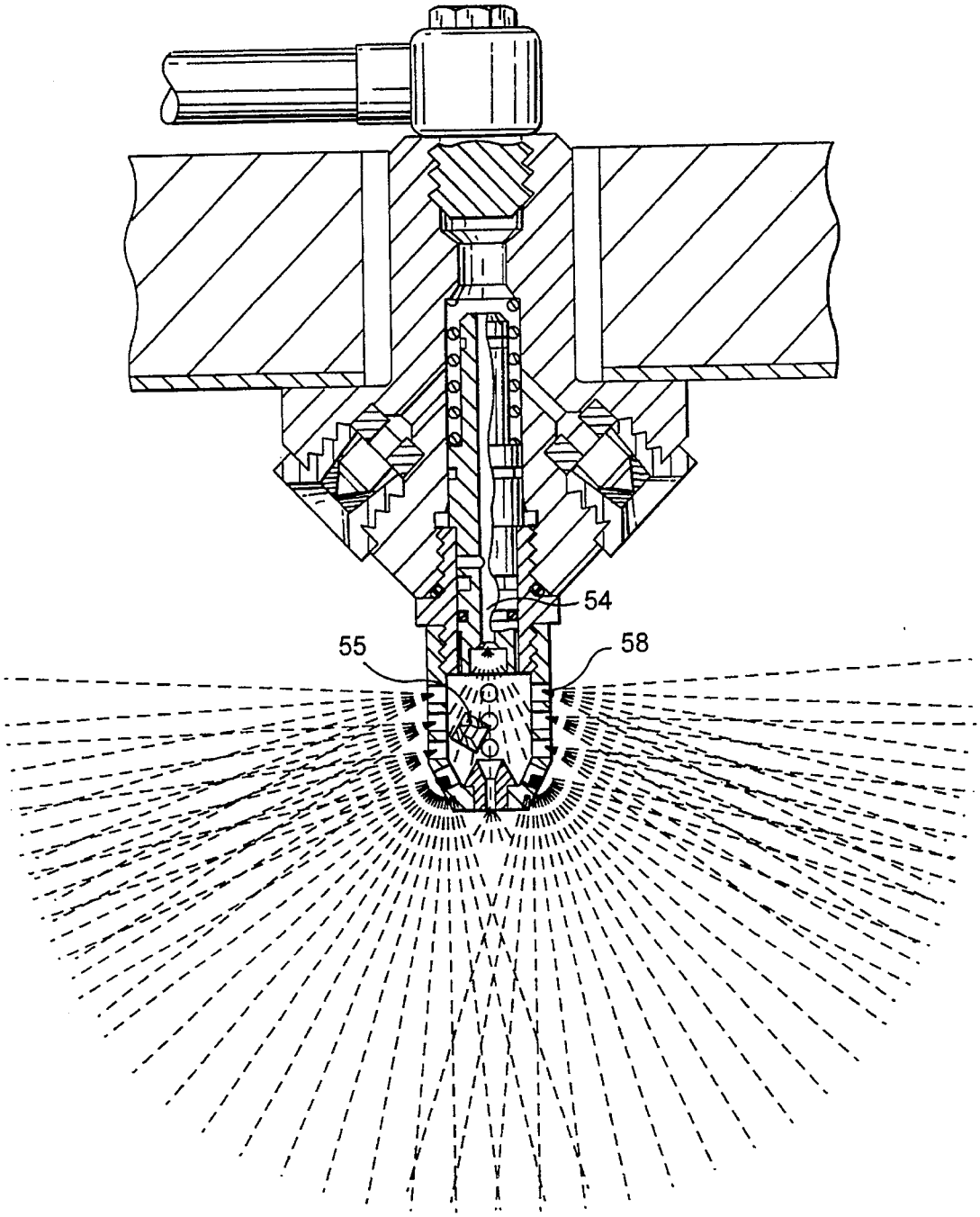
FIG. 16 shows the same embodiment with increased spraying of fire fighting liquid.

In FIGS. 14 to 19, the valve spindle of the spray head is indicated with 51; its release means comprising a glass ampoule is indicated with 52; and a protection cap surrounding the ampoule and supporting it from the below is indicated with 53. An axial boring through the spindle 51 is indicated with 54. As distinct from the embodiments shown in FIGS. 5 to 11, the axial boring 54 runs through the entire spindle 51, so that the outer end of the boring 54 is provided with a plug against which the ampoule 52 bears. In FIGS. 14 to 16, the plug is indicated with 55, in FIGS. 17 and 18 with 56, and in FIG. 19 with 57.

Figure 5:
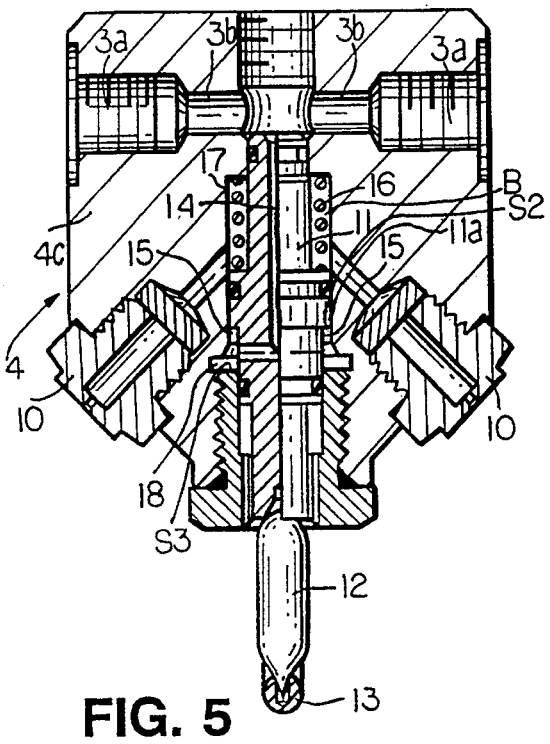
FIGS. 5 and 6 are sectional views of an individual spray head in rest state.
Figure 17:
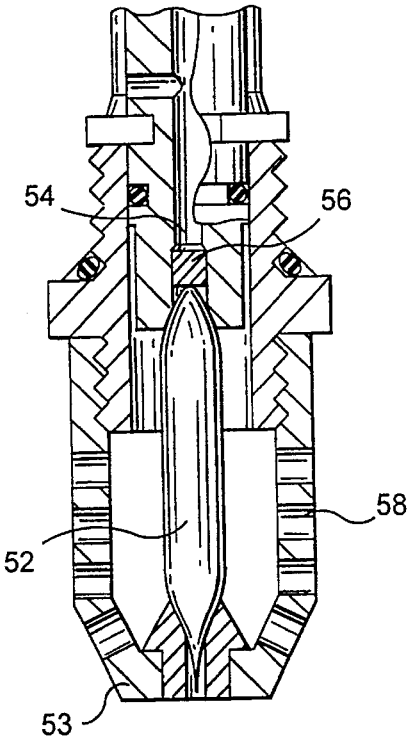
FIGS. 17 and 18 and FIG. 19 show two alternatives for closing the axial boring of the valve piston.
Figure 18:
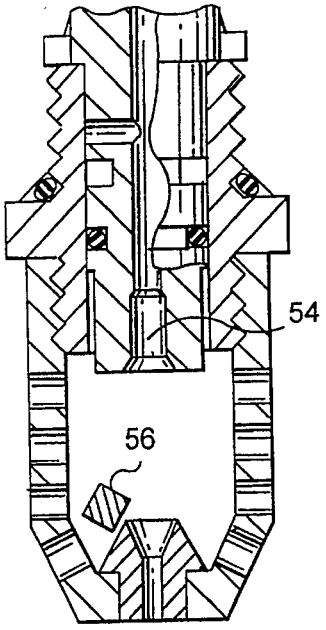
Figure 19:
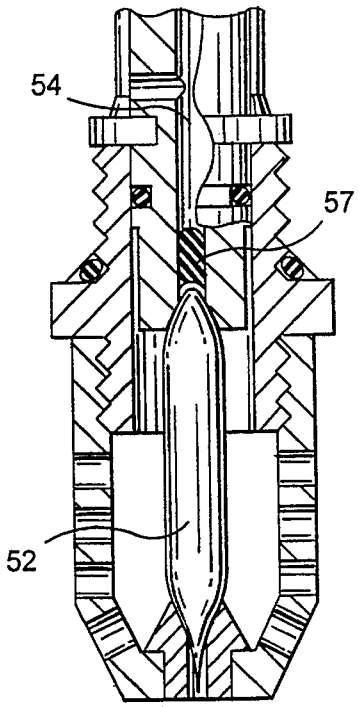

In FIG. 14, the spray head is in an inactivated state similarly as in FIGS. 5, 6 and 11. In FIG. 15, the release ampoule 52 has broken and fog-like fire fighting liquid is sprayed through the spray head nozzles similarly as in FIGS. 7 and 8. The amount of high-pressure water is typically about 2 to 3 liters/minute. However, if so-called over-ignition takes place, and the fog shown in FIG. 15 is able to only partially smother the fire, the temperature keeps rising. Preferably, the plug 55 is fixed by soldering with a solder material which melts at e.g. about 200° C., so that the plug 55 comes off when this temperature is reached, and the boring 54 through the valve spindle 51 opens, and so the high-pressure water may flow out into the protection caps 53 having openings 58 through which the water is distributed in the same way as in a conventional spray head system, i.e. in an amount of about 50 liters/minute. Fire fighting with fog is continued simultaneously. FIG. 16 shows this situation. In FIGS. 17 and 18, the plug 56 is arranged essentially in the same way as the plug 55 but it is smaller and simpler in structure. In FIG. 19, the plug 57 is entirely of a solder material. In place of soldering, it might be possible to make the plug of a metal that shrinks with rising temperature.

The combination of two systems shown in FIGS. 14 to 19 improves the fire extinguishing effect and the total capacity of the system. Also, the demand of water and the size of the pipelines is only a fraction of those required in conventional spray head systems; it is highly probable that over-ignition occurs at several points simultaneously. In case of a normal fire, extinguishing with fog is adequate.

Transition from the so-called fog formation stage to the highly effective fire fighting can be delayed unnecessarily as the moist fog cools the lower portion of the spray head, where the fuse is disposed, thus delaying the melting of the fuse.

Figure 20:
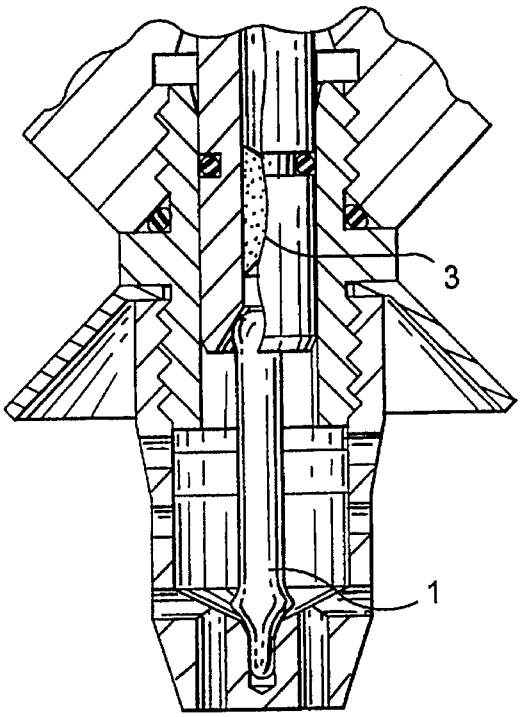
FIG. 20 shows an embodiment with an umbrella-like member in a position before a fire.
Figure 21:
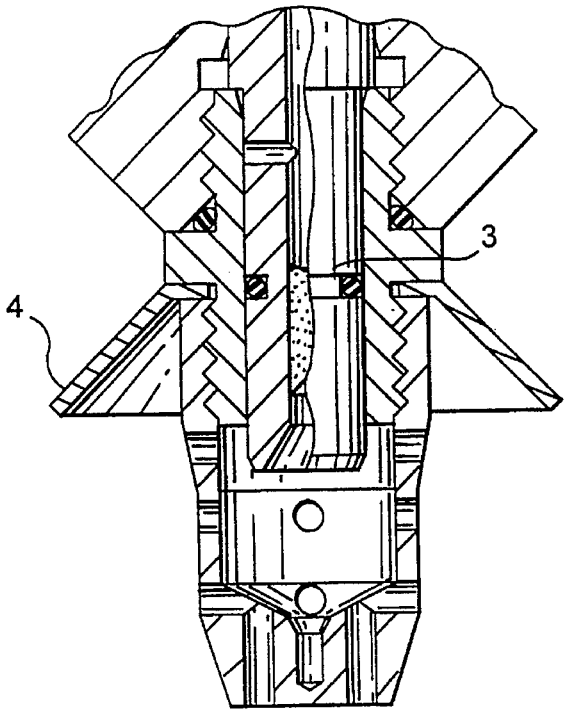
FIG. 21 shows the situation after a fire has broken out at the fire fighting stage called fog-formation.

To solve this problem, it is suggested in FIGS. 20 and 21 that an umbrella-like member 4' is provided between the fog formation nozzles (not shown) on an upper portion 4*a* of a spray head and the lower portion 46 of the spray head.

In FIG. 20, the ampoule is intact. When a fire breaks out, hot air rises up toward the umbrella-like member between the fog formation nozzles and the lower portion of the spray head, where not only the ampoule but also a fuse f of e.g. a solder material, is positioned. The umbrella-like member leads the hot air against the ampoule and causes it to be broken rapidly.

In FIG. 21, the fire fighting is in progress through so-called fog formation via the nozzles. The umbrella-like member prevents the fog drops from cooling the lower portion of the spray head; if the fog formation is inadequate to extinguish the fire, the plugs P of solder material melts rapidly, whereafter the highly effective fire fighting is initiated by direct spraying of water through the lower portion of the spray head, as described above.

I claim:

1. A spray head for fire fighting, comprising:

a housing with an inlet and a central boring and at least one nozzle, a movable spindle arranged in said boring, the spindle comprising a shoulder for defining a first annular space between the spindle and a surrounding boring wall, said spindle having a first end and a second end, said first end having a projected area facing against and being subject to liquid pressure prevailing in the inlet, the first annular space communicating with a feed line and having a cross-sectional projected area transverse to the axis of the spindle, said cross-sectional projected area of the annular space being substantially the same as said projected area of the spindle, a spring force being arranged to press said second end of the spindle against a thermally-activated release means of the spray head.

2. A spray head according to claim 1, wherein said first annular space communicates with the feed line through an axial conduit provided in the spindle.

3. A spray head according to claim 1, wherein said spring force is generated by a spiral spring in a second annular space communicating with said at least one nozzle of the spray head.

4. A spray head according to claim 3, wherein said second annular space communicates with a pressure switch.

5. A spray head according to claim 1, including means for closing the communication between the first annular space and the inlet and for damping the movement of the spindle.

6. A spray head according to claim 2, wherein an air bleeding valve is arranged in communication with the axial conduit of the spindle.

7. A spray head according to claim 2, wherein a second shoulder is provided at the second end of the spindle for contact with a retainer element.

8. A spray head according to claim 2, wherein said axial conduit is provided at an end thereof with a plug in contact with said release means of the spray head, said plug being arranged to come off the end of said axial conduit at a temperature higher than the release temperature of said release means.

9. A spray head according to claim 1, wherein an electric heating coil is provided around the release means.

10. A spray head according to claim 8, wherein said plug is fixed by soldering to said end of said axial conduit, the solder material being adapted to melt at a predetermined temperature.

11. In a spray head for fighting a fire, the spray head having a boring for connecting a feed line for fire-extinguishing liquid to outlet means for letting the fire-extinguishing liquid out for the fighting of the fire, a spindle having a first end and a second end and being movable in an axial direction in the boring from a first position which blocks the boring to a second position which does not block the boring, a projected area of the first end of the spindle facing the feed line and being subjected to a pressure of the fire-extinguishing liquid from the feed line for tending to move the spindle from the first position in the axial direction, and thermally-activated release means for preventing the movement of the spindle from the first position in the axial direction until released in response to the fire, the improvement comprising:

a shoulder on the spindle for defining a first annular space between the spindle and the boring that is closed at one end by the shoulder, said first annular space having a cross-sectional projected area traverse to the axis of the spindle, said cross-sectional projected area of the first annular space being substantially the same as the projected area of the first end of the spindle;

means for communicating the pressure of the fire-extinguishing liquid from the feed line to the first annular space in order to cancel the liquid pressure acting on said projected area of the first end of the spindle and tending to move the spindle from the first position in the axial direction; and force means for providing a force for moving the spindle in the axial direction from the first position to the second position when released by the release means.

12. A spray head for fire fighting comprising:

a housing (4) with an inlet;

a feed line and a central boring in said housing (4);

at least one nozzle (10) in said housing (4);

a movable spindle (11) having a first and a second end arranged in said housing (4) said first end of said spindle having a projected area facing against said feed line and being subject to pressure from the feed line;

a spring force (16) arranged to press said spindle (11) against a thermally activated release means (12) when said spindle is in a first position corresponding to a rest position of said spray head in which rest position said spindle closes communication between said inlet and said at least one nozzle (10);

a shoulder (11*a*) provided in said spindle (11) for defining a first annular space (15) between the spindle and a surrounding wall of said central boring when said release means (12) is unbroken and said spindle is in said first position, wherein said shoulder (11*a*) defines a surface with a cross-sectional projected area traverse to the axis of said spindle (11) which is substantially the same size as the projected area of said first end of said spindle being subject to pressure; and a conduit (14) for communication between said first annular space (15) and said inlet being provided, whereby said surface of said shoulder is subject to pressure from said feed line when the release means (12) is unbroken and said spindle (11) is in said first position;

said spring force (16) being arranged to move said spindle (11) to a second position after breakage of said release means (12) in which said communication between the first annular space (15) and said inlet is closed and communication between said inlet and said at least one nozzle (10) is open to allow for pressure from said feed line to said at least one nozzle (10).

13. A spray head according to claim 12, wherein said surface of the shoulder (11*a*) abuts a mating surface of the spray head in order to close said communication between the first annular space (15) and the inlet when said spindle (11) is in said second position.

14. A spray head according to claim 12, wherein said release means is a glass ampoule (12).

* * * * *